US008727385B2

(12) United States Patent
Shinoda

(10) Patent No.: US 8,727,385 B2
(45) Date of Patent: May 20, 2014

(54) GAS DISTRIBUTION UNIT

(75) Inventor: Koji Shinoda, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 365 days.

(21) Appl. No.: 13/160,767

(22) Filed: Jun. 15, 2011

(65) Prior Publication Data

US 2011/0315244 A1 Dec. 29, 2011

(30) Foreign Application Priority Data

Jun. 29, 2010 (JP) ..... 2010-147422

(51) Int. Cl.
*F15D 1/00* (2006.01)
*G01M 15/10* (2006.01)

(52) U.S. Cl.
USPC ..... 285/124.2; 285/124.5; 403/24; 403/34; 138/115

(58) Field of Classification Search
USPC ..... 137/351; 55/342; 138/103, 109, 111, 138/115, 117; 403/24, 34, 177; 285/124.1–124.5, 136.1, 179, 285.1; 73/23.31
See application file for complete search history.

(56) References Cited

U.S. PATENT DOCUMENTS

| | | | | |
|---|---|---|---|---|
| 3,125,360 | A * | 3/1964 | Ulrich | 285/124.5 |
| 3,469,863 | A * | 9/1969 | Riester et al. | 285/124.4 |
| 3,470,893 | A * | 10/1969 | Nelson | 137/68.11 |
| 3,933,379 | A * | 1/1976 | Pontigny | 285/381.4 |
| 4,116,476 | A * | 9/1978 | Porter et al. | 285/124.4 |
| 4,722,559 | A * | 2/1988 | Bongartz | 285/122.1 |
| 5,298,225 | A | 3/1994 | Higdon | |
| 6,926,311 | B2 * | 8/2005 | Chang et al. | 285/317 |
| 8,092,409 | B2 * | 1/2012 | Mros et al. | 601/151 |
| 8,256,459 | B2 * | 9/2012 | Tesluk et al. | 137/614.05 |
| 8,256,801 | B2 * | 9/2012 | Hagen et al. | 285/124.5 |
| 2002/0163187 | A1 * | 11/2002 | Pelfrey et al. | 285/124.1 |
| 2003/0146619 | A1 * | 8/2003 | Souvatzidis et al. | 285/124.5 |
| 2006/0001261 | A1 * | 1/2006 | Miyajima et al. | 285/136.1 |
| 2009/0140515 | A1 * | 6/2009 | Ichimura et al. | 285/124.5 |
| 2011/0225988 | A1 * | 9/2011 | Baust et al. | 62/50.7 |

FOREIGN PATENT DOCUMENTS

| | | | |
|---|---|---|---|
| JP | 2010-62035 | | 3/2010 |
| JP | 2010062035 | A * | 3/2010 |
| WO | 2010027009 | A1 | 3/2010 |

OTHER PUBLICATIONS

English Translation of JP 2010062035.*

* cited by examiner

*Primary Examiner* — Hezron E Williams
*Assistant Examiner* — Alexander Mercado
(74) *Attorney, Agent, or Firm* — Gerald E. Hespos; Michael J. Porco; Matthew T. Hespos

(57) ABSTRACT

A gas distribution unit includes a block body (11) made of synthetic resin and to be fixed in a case (20) of an exhaust gas measuring apparatus. An intake passage (15) for device to be connected to an intake pipe (54) and an intake connecting portion (42), an exhaust passage (16) for device to be connected to an exhaust pipe (28) and an exhaust connecting portion (43), and air passages (14) for measuring device to be connected to pipes (53) for measuring device and intake connecting portions (61) are provided in the block body (11).

11 Claims, 11 Drawing Sheets

GAS DISTRIBUTION UNIT

BACKGROUND OF THE INVENTION

1. Field of the Invention

The invention relates to a gas distribution unit.

2. Description of the Related Art

Japanese Unexamined Patent Publication No. 2010-62035 and FIG. 12 herein disclose a connector with an integral assembly of a joint pipe for introducing exhaust gas from an exhaust pipe to an exhaust gas measuring apparatus to measure components of the exhaust gas of an automotive vehicle and a joint terminal for introducing power from a power feeding apparatus. The connector is provided on a case 1 of the exhaust gas measuring apparatus installed in the automotive vehicle, as shown in FIG. 12. A joint terminal 2 mounted in the connector is connected to a control board 3 in the case 1 and joint pipes 4 are connected to various devices in the case, such as a measuring device 5 and a pump 6 by gas tubes 7. A mating connector can be connected to this connector to supply exhaust gas to the various devices in the exhaust gas measuring apparatus and to supply power to the control board 3.

Since the exhaust gas measuring apparatus is installed in the automotive vehicle, miniaturization of the case has been studied and an internal space of the case has become very small. Inserting an operator's hands into the case for connecting the joint pipes of the connector and the respective devices by the gas tubes 7 has been difficult. Further, a gas flow passage for the exhaust gas could be closed by squashing the flexible hose while bending the hose in conformity with the internal space of the case.

The invention was developed in view of the above situation and an object is to improve assembly by facilitating an arrangement of gas flow passages in a case.

SUMMARY OF THE INVENTION

The invention relates to a gas distribution unit including a block body made of synthetic resin and to be fixed in a case of an exhaust gas measuring apparatus. The gas distribution unit comprises an intake passage having one end to be connected to an intake pipe on the case and the other end to be connected to an intake connecting portion on a device in or at the case. The gas distribution unit also has an exhaust passage having one end to be connected to an exhaust pipe on the case and the other end to be connected to an exhaust connecting portion on the device. An air passage having one end to be connected to a pipe for measuring device on the case and the other end to be connected to an intake connecting portion in or at the case. The intake passage, the exhaust passage and the air passage are provided in the block body. Thus, the device and the measuring device can be joined easily with the respective pipes in the case. Further, the synthetic resin block body prevents problems such as closure of gas flow passages due to bending.

The case may include a base to which the block body is to be fixed, and a cover to be mounted on the base to cover a surface of the base.

The intake pipe and the pipe for measuring device may be provided on an outer wall of the cover and may penetrate through the cover.

A connecting tube may provided at the one end of the intake passage for device and a connecting tube portion for measuring device provided at the one end of the air passage for measuring device may be provided on the upper surface of the block body.

The connecting tube for device may be connected to the intake pipe and the connecting tube for measuring device may be connected to the pipe for measuring device when the cover is mounted on the base. Thus, the intake pipe and the pipe for measuring device can be connected easily to the block body by mounting the cover after the block body is fixed to the base.

A seal for sealing between the inner surface of the cover and the upper surface of the block body may be provided at one or more outer peripheral portions of base ends of the connecting tube for device and the connecting tube for measuring device. Thus, a clearance between the cover and the block body can be sealed in an airtight manner.

The cover may include plural pipes for measuring device; the measuring device may include plural intake connecting portions; and the block body may be formed with plural air passages for measuring device substantially corresponding to the pipes for measuring device and the intake connecting portions. Thus, the air passages for measuring device can be connected collectively to the measuring device and the pipes for measuring device to improve assembling efficiency.

An annular seal may be provided between the base and the cover.

One or more seals may be provided to seal clearances between the intake connecting portions and the connecting pipes for measuring device to prevent the exhaust gas or fluid from flowing into the case. Similarly, one or more seals may be provided to seal a clearance between the intake connecting portion and the intake passage for device to prevent the exhaust gas or fluid from flowing into the case.

A connector may be provided on the case and may include one or more joint pipes to be connected to one or more respective mating joint pipes provided in a mating connector to introduce exhaust gas supplied from the unillustrated mating connector into the case and/or one or more joint terminals to connect to one or more respective mating terminals in the mating connector.

Arranging the block body in the case may comprise fixing the block body to a base of the case and may further comprise mounting a cover on the base to cover a surface of the base.

The intake pipe and the pipe for measuring device are provided on an outer wall of the cover and penetrate through the cover.

A connecting tube for device provided at one end of the intake passage for device and a connecting tube for measuring device provided at the one end of the air passage for measuring device may be provided on the outer surface of the block body. The connecting tube for device is to be connected to the intake pipe and the connecting tube for measuring device may be connected to the pipe for measuring device when the cover is mounted on the base.

These and other objects, features and advantages of the invention will become more apparent upon reading of the following detailed description of preferred embodiments and accompanying drawings.

DETAILED DESCRIPTION OF THE PREFERRED EMBODIMENTS

Figure 1:
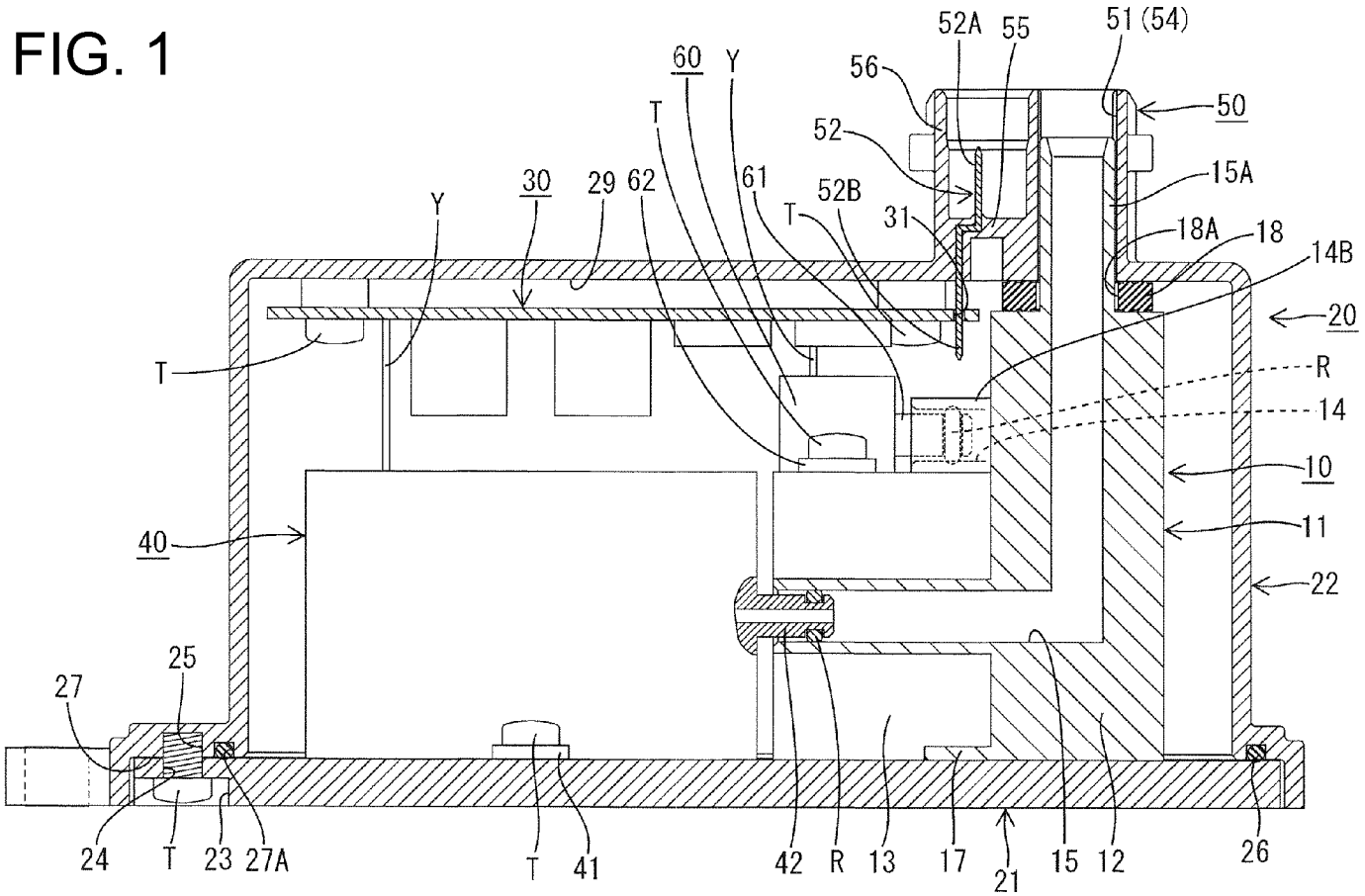
FIG. 1 is a section showing a state where a gas distribution unit according to one embodiment is assembled into a case of an exhaust gas measuring apparatus.

A gas distribution unit in accordance with the invention is identified by the numeral 10 in FIGS. 1 to 11. The gas distribution unit 10 is to be mounted in a substantially block-shaped case 20 of an exhaust gas measuring apparatus installed in an automotive vehicle, as shown in FIG. 1.

The exhaust gas measuring apparatus includes, as shown in FIG. 1, the case 20 made e.g. of synthetic resin, at least one control board 30 to be assembled into the case 20, and an electric pump or fluid displacement member 40 to be assembled into the case 20.

The case 20 includes a base 21 made e.g. of synthetic resin and a cover 22 made e.g. of synthetic resin and adapted to cover substantially the entire upper surface of the base 21.

The base 21 is a substantially rectangular plate and screw accommodating portions 23 are provided at corners of the bottom surface of the base 21 for accommodating the head of a tapping screw T. An insertion hole 24 is provided in the center of each screw accommodating portion 23 for receiving a shaft of the tapping screw T. The base 21 and the cover 22 are fixed to each other by screwing the tapping screws T into the respective insertion holes 24 from the bottom of the base 21 and into respective screw holes 25 formed at corners of an opening edge of the cover 22, as shown in FIG. 1.

The electric pump 40 is fixed to the upper surface of the base 21, as shown in FIG. 1. More particularly, pump fixing pieces 41 are provided at opposite lateral left and right lateral sides of the electric pump 40. Tapping screws T are inserted into unillustrated screw holes of the pump fixing pieces 41 and are screwed into the base 21 to assemble the electric pump 40 with the base 21.

The cover 22 is hood-shaped and a stepped portion 27 is widened outwardly over substantially the entire periphery at the opening edge of the cover 22, as shown in FIG. 1. A groove 27A is formed in the stepped portion 27 and extends around the entire periphery of the cover 22 at positions inward of the screw holes. An annular seal 26 is fit in the groove 27A, as shown in FIG. 1. The annular seal 26 prevents the entrance of water or fluid into the case 20 through a clearance between the base 21 and the cover 22.

As shown in FIG. 1, a connector 50 is formed unitarily to the upper wall of the cover 22 and vertically penetrates through the cover 22.

Four side-by-side substantially cylindrical joint pipes 51 are formed unitarily with the connector 50 and penetrate straight through the connector 50 from the upper end to the lower end. The joint pipes 51 can be connected to unillustrated mating joint pipes in a mating connector to introduce exhaust gas supplied from the unillustrated mating connector into the case 20. Three of the joint pipes 51 may function as pipes 53 for a measuring device and the remaining joint pipe 53 may function as an intake pipe 54.

The connector 50 also includes four joint terminals 52. As shown in FIG. 1, each joint terminal 52 extends vertically but is cranked at an intermediate position. The cranked central intermediate parts of the joint terminals 52 are insert molded integrally in a terminal holding portion 55. The joint terminals 52 are held substantially side by side in an arrangement direction of the joint pipes 51 in the terminal holding portion 55.

Upper end connecting portions 52A are defined a upper ends of the joint terminals 52 and project from a back wall of a receptacle 56 provided above the terminal holding portion 55. The receptacle 56 is open up and can receive the unillustrated mating connector therein so that the upper end connecting portions 52A electrically connect to respective unillustrated mating terminals in the mating connector. Lower-end connecting portions 52B are defined at lower ends of the joint terminals 52 and project straight down from the lower end surface of the terminal holding portion 55.

The lower-end connecting portions 52B penetrate through holes 31 in the control board 30 and electrically connect to the control board 30. The control board 30 is assembled with the cover 22 by inserting tapping screws T into unillustrated screw holes in the surface of the control board 30 and screwing the tapping screws T into an upper inner surface 29 of the cover 22. The control board 30 is connected electrically to the electric pump 40 mounted on the base 21 by at least one lead wire Y.

The gas distribution unit 10 fixed to the base 21 of the exhaust gas measuring apparatus includes a block body 11 formed integrally or unitarily of a rigid synthetic resin. The block body 11 includes, as shown in FIGS. 2 to 7, a large box 12 with a stepped lateral surface and a small box 13 projecting from the front end of the large box 12.

Figure 3:
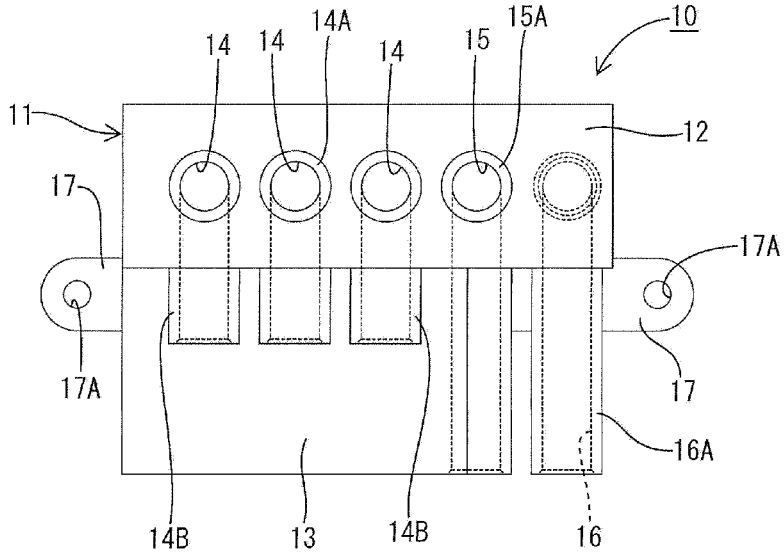
FIG. 3 is a plan view of the gas distribution unit.
Figure 4:
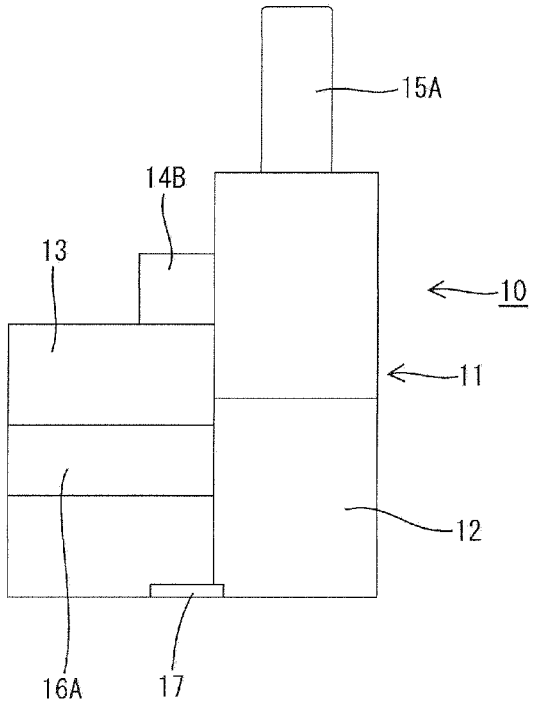
FIG. 4 is a side view of the gas distribution unit.
Figure 8:
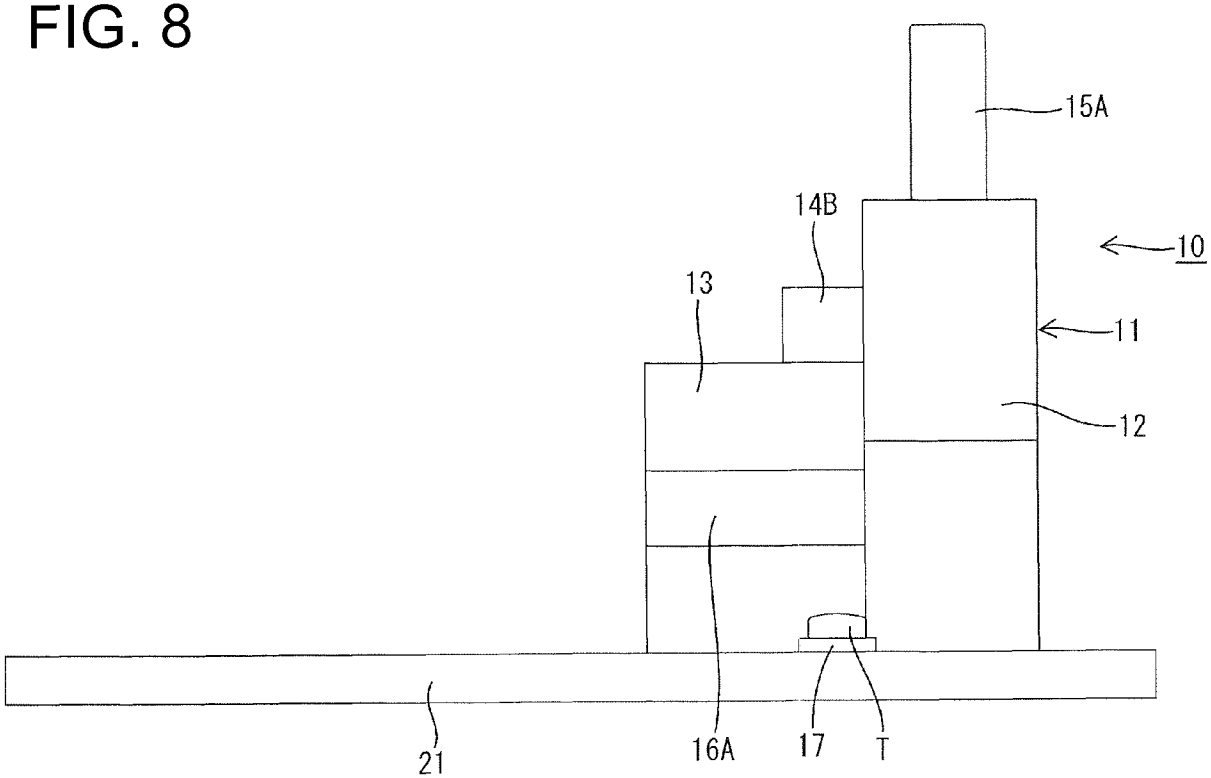
FIG. 8 is a section showing a state where the gas distribution unit according to embodiment is mounted on a base.

Air passages 14 for measuring device extend through the large and small boxes 12, 13, at least one intake passage 15 for device extends through the large and small boxes 12, 13 and an exhaust passage 16 for device extends through the large box 12. Fixing pieces 17 are provided at the opposite left and right sides of a boundary between the large and small boxes 12, 13 and a screw insertion hole 17A is formed substantially in the center of each fixing piece 17, as shown in FIG. 3. Tapping screws T are inserted into the screw insertion holes 17A and screwed into the base 21, as shown in FIG. 8, to fix the block body 11 to the base 21.

Figure 7:
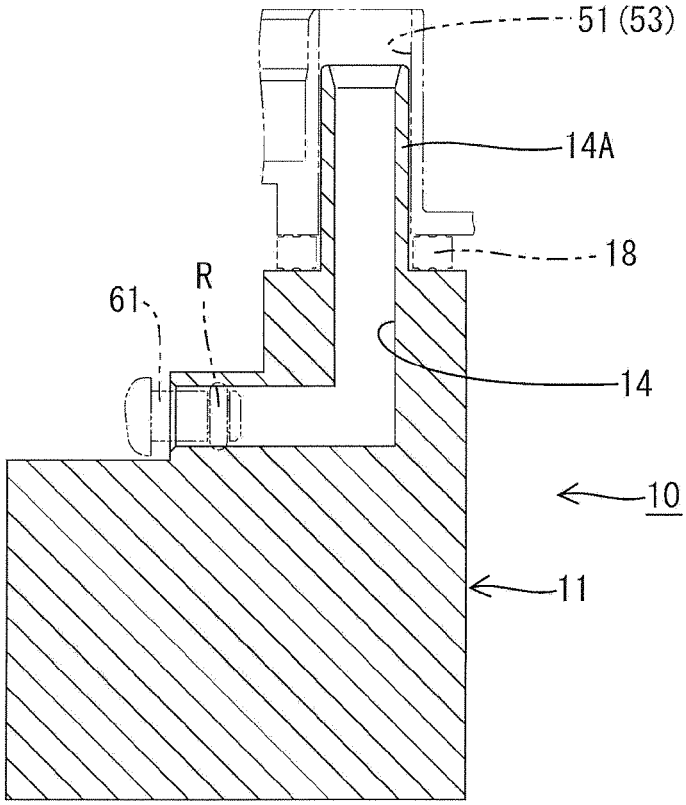
FIG. 7 is a section along VII-VII of FIG. 2.

The three air passages 14 for measuring device are arranged substantially side by side in the large box 12 and define L-shapes to extend from the upper side to the front side as shown in FIGS. 3 and 7. One end of each air passage 14 for measuring device defines a substantially cylindrical connecting tube 14A for measuring device and extends substantially straight up from the upper end surface of the large box 12. The other end of each air passage for measuring device defines a connecting pipe 14B for measuring device projecting from a side surface of the large box 12 at the side of the small box 13 and opens forward, as shown in FIGS. 1 to 3 and 7.

The connecting tubes 14A for measuring device have substantially the same outer diameter as the inner diameter of the joint pipes 51 of the connector 50 in the cover 22. Further, the connecting tubes 14A for measuring device are arranged at positions corresponding to the pipes 53 for measuring device provided in the cover 22. Thus, the connecting tubes 14A for measuring device are accommodated and fit into the connecting pipes 14B for measuring device when the cover 22 is assembled with the base 21.

The connecting pipes 14B for measuring device are to be connected to a measuring device 60 fixed to the top surface of the small box 13. The measuring device 60 is connected to the block body 11 by inserting intake connecting portions 61 on a side surface thereof into the connecting pipes 14B for measuring device. The measuring device 60 is to be fixed to the small box 13 particularly by screwing tapping screws T into measuring device fixing pieces 62 at opposite widthwise sides. Further, the measuring device 60 is to be connected electrically to the control board 30 by at least one lead wire Y.

O-rings R are mounted on the outer peripheral surfaces of the intake connecting portions 61 and closely contact outer peripheral surfaces of the intake connecting portions 61 and the inner peripheral surfaces of the connecting pipes 14B for measuring device. The O-rings R seal clearances between the outer peripheral surface of the intake connecting portions 61 and the inner peripheral surfaces of the connecting pipes 14B for measuring device to prevent the exhaust gas or fluid from flowing into the case 20.

Figure 2:
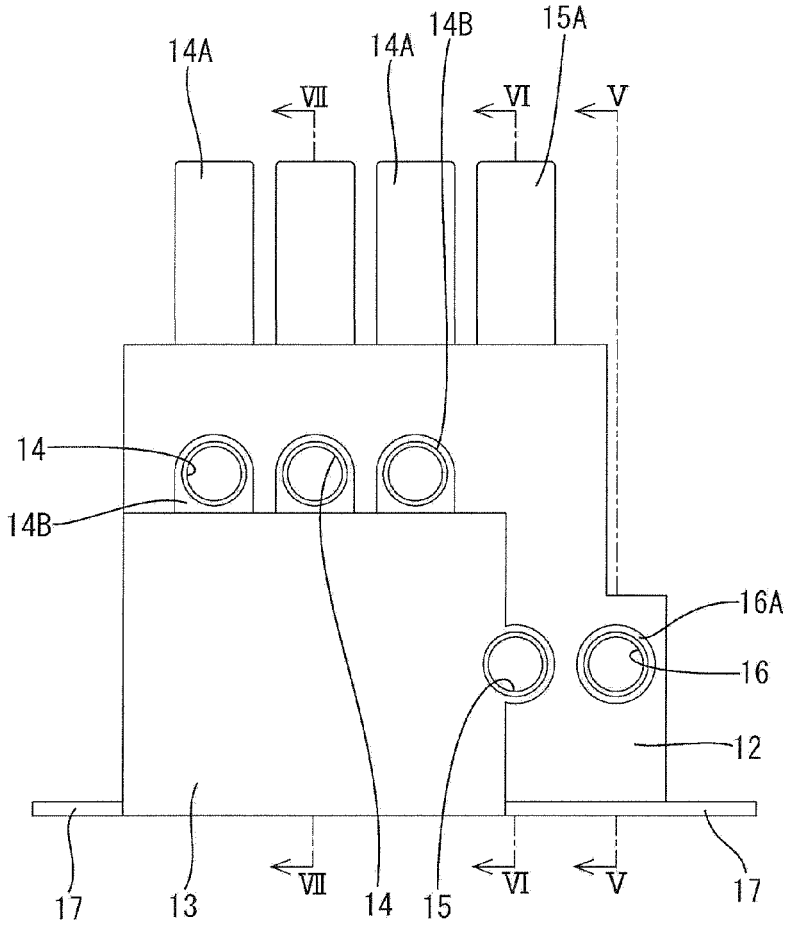
FIG. 2 is a front view of the gas distribution unit according to the embodiment.
Figure 6:
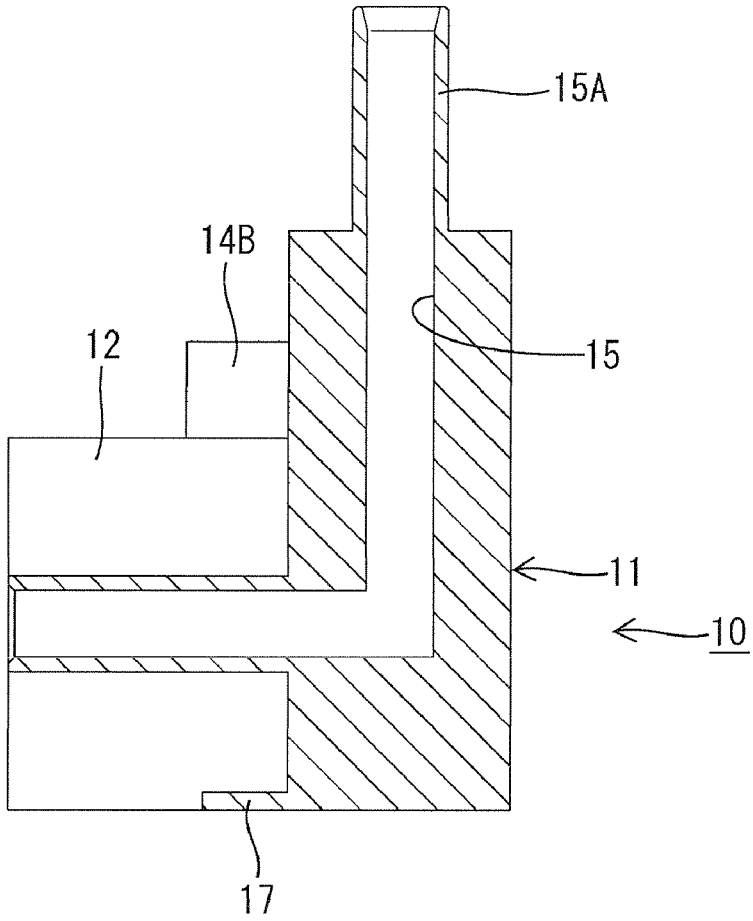
FIG. 6 is a section along VI-VI of FIG. 2.

Similar to the air passages 14 for measuring device, the intake passage 15 for device is L-shaped and extends from the top to the front of the large box 12, as shown in FIG. 6. A substantially cylindrical connecting tube 15A for device is defined at one end of the intake passage 15 for device and extends substantially straight up from the upper end surface of the large box 12 while the other end thereof is open in the front of the small box 13, as shown in FIGS. 1 to 3. Further, the intake passage 15 for device is formed to cause a side surface of the small box 13 to bulge out.

Similar to the connecting tubes 14A for measuring device, the connecting tube 15A for device has an outer diameter substantially equal to the inner diameter of the joint pipes 51 of the connector 50 in the cover 22, as shown in FIG. 1. Further, the connecting tube 15A for device is arranged at a position substantially corresponding to the intake pipe 54 in the cover 22. Thus, the connecting tube 15A for device is fit into the intake pipe 54 as shown in FIG. 1 when the cover 22 is assembled with the base 21.

A seal 18 is provided outward of base ends of the connecting tubes 14A for measuring device and the connecting tube 15A for device and is pressed between the upper inner surface 29 of the cover 22 and the upper end surface of the large box 12, as shown in FIG. 1. This seal 18 is somewhat smaller than the outer shape of the upper end of the large box 12. This surface seal 18 includes (e.g. four) tube insertion holes 18A for sealing with the outer peripheral surfaces of the connecting tubes 14A for measuring device and the connecting tube portion 15A for device. This seal 18 seals between the upper inner surface 29 of the cover 22 and the upper end surface of the large box 12 as shown in FIG. 1, thereby preventing the exhaust gas or fluid from flowing into the case 20.

Figure 9:
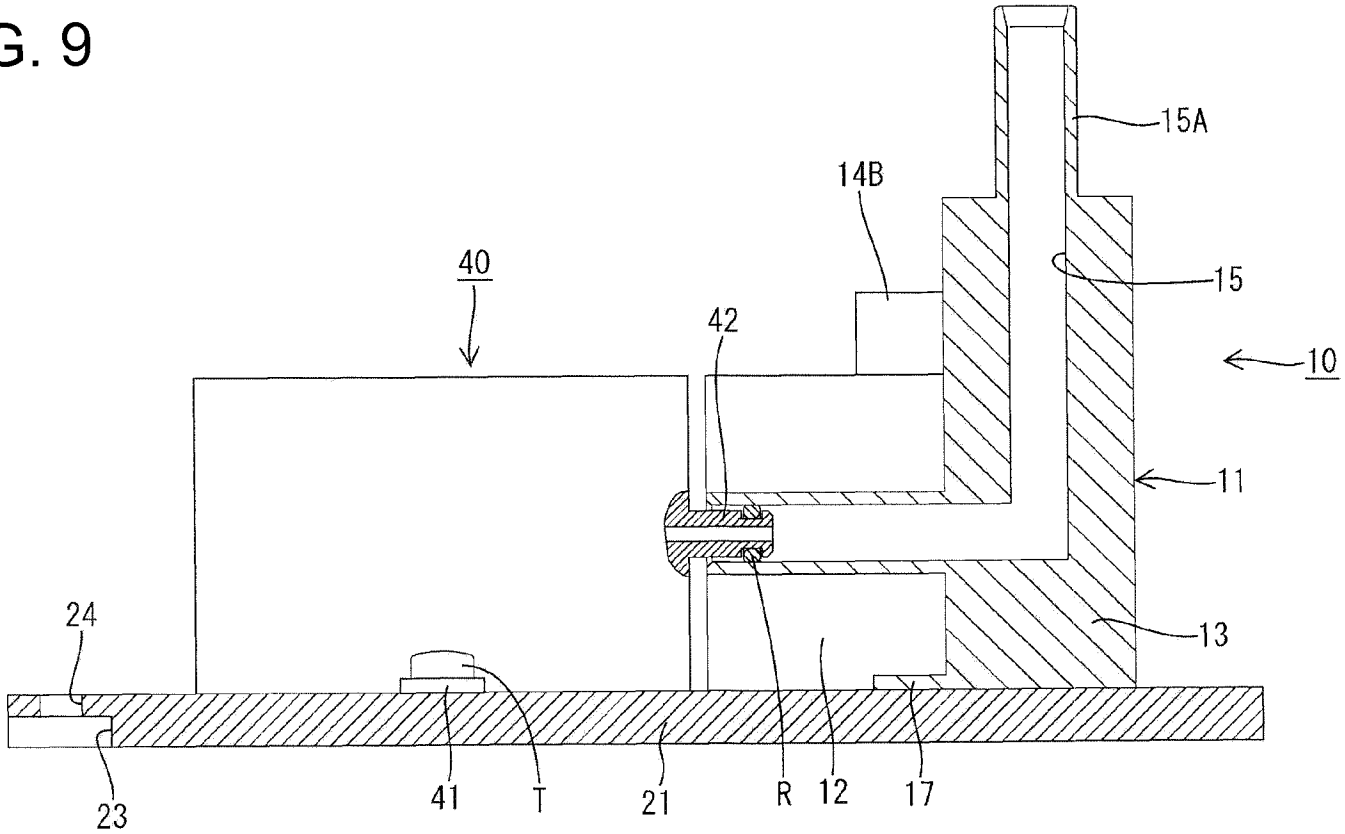
FIG. 9 is a section showing a state where the gas distribution unit and an electric pump are mounted on the base.
Figure 10:
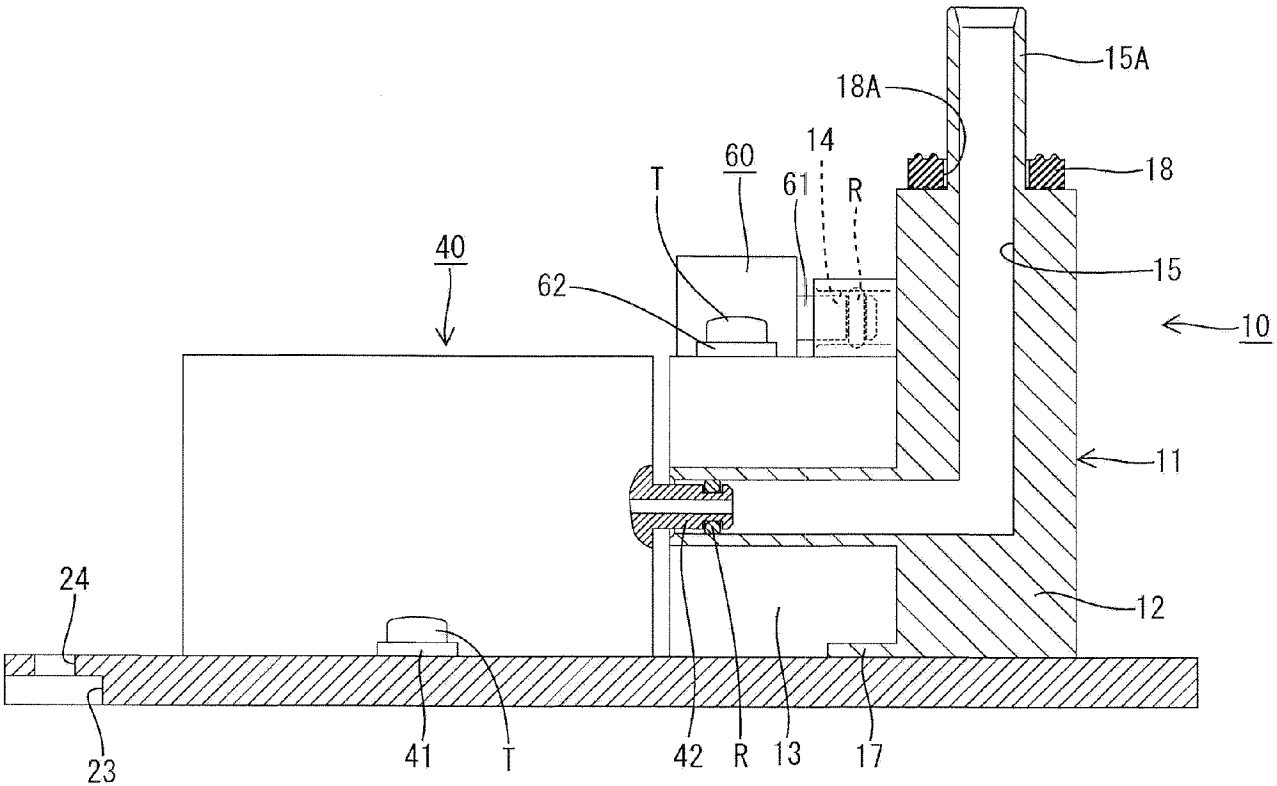
FIG. 10 is a section showing a state where a measuring device and a seal member are fixed to the gas distribution unit fixed to the base.

As shown in FIGS. 1 and 9, at least one intake connecting portion 42 is provided on a side surface of the electric pump 40 and is fit into the opening of the intake passage 15 for device that is open in the front end surface of the small box 13. An O-ring R is mounted on the outer peripheral surface of the intake connecting portion 42 and closely contacts the outer peripheral surface of the intake connecting portion 42 and the inner peripheral surface of the intake passage 15 for device. The O-ring R seals a clearance between the outer peripheral surface of the intake connecting portion 42 and the inner peripheral surface of the intake passage 15 for device to prevent the exhaust gas from flowing into the case 20.

As shown in FIGS. 2 to 5, the exhaust passage 16 for device is L-shaped and extends from the front to the bottom of the large box 12. One end of the exhaust passage 16 for device is open in the bottom of the large box 12 and the other end defines an exhaust connecting pipe 16A projecting forward from the front end of the large box 12.

An exhaust pipe 28 projects up from the upper surface of the base 21 and is fit into the opening of the exhaust passage 16 for device in the bottom of the large box 12. An O-ring R is to be mounted on the outer peripheral surface of this exhaust pipe 28 and closely contacts the inner peripheral surface of the exhaust passage 16 for device and the outer peripheral surface of the exhaust pipe 28. The O-ring R seals a clearance between the inner peripheral surface of the exhaust passage 16 for device and the outer peripheral surface of the exhaust pipe 28 to prevent the exhaust gas from flowing into the case 20.

Figure 5:
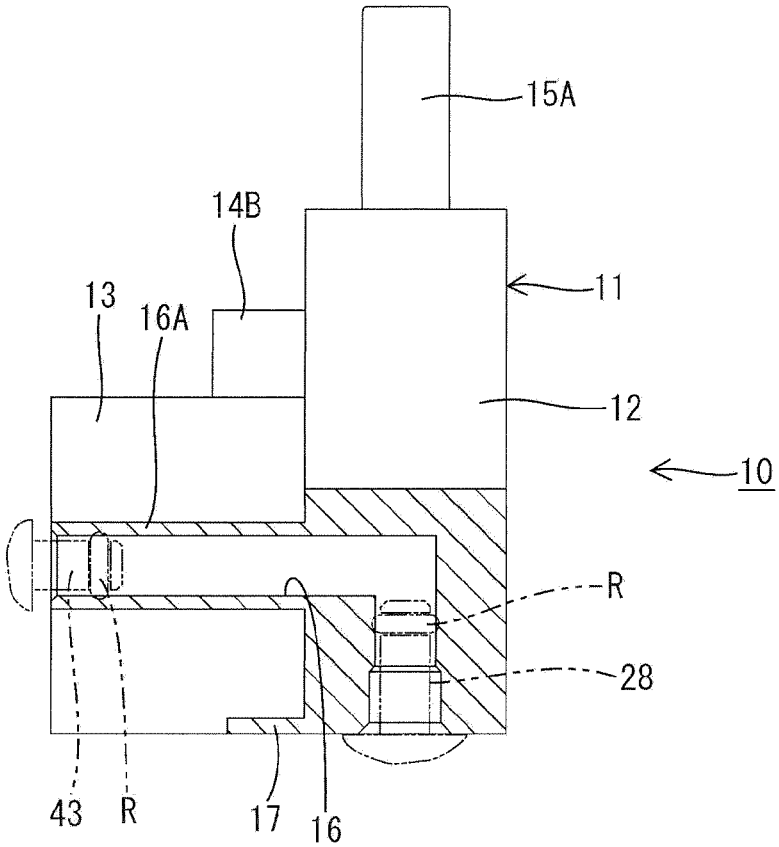
FIG. 5 is a section along V-V of FIG. 2.

The exhaust connecting portion 42 is arranged substantially side by side with the intake connecting portion 42 on the side surface of the electric pump 40 and is fit into the exhaust connecting pipe 16A through the opening as shown in FIG. 5. An O-ring R is mounted on the outer peripheral surface of the exhaust connecting portion 43 and closely contacts the outer peripheral surface of the exhaust connecting portion 43 and the inner peripheral surface of the exhaust passage 16 for device. This O-ring R seals a clearance between the outer peripheral surface of the exhaust connecting portion 43 and the inner peripheral surface of the exhaust passage 16 for device to prevent the exhaust gas from flowing into the case 20.

First, as shown in FIG. 8, the block body 11 of the gas distribution unit 10 is arranged on the base 21 of the case 20 and fixed to the base 21 by the tapping screws T. At this time, the block body 11 is arranged so that the exhaust passage 16 for device is fit into the exhaust pipe 28 on the base 21, as shown in FIG. 5.

Subsequently, as shown in FIG. 9, the intake connecting portion 42 of the electric pump 40 is inserted into the opening of the intake passage 15 for device from a lateral side of the block body 11 and the exhaust connecting pipe 43 is fit into the exhaust connecting pipe 16A of the exhaust passage 16 for device, thereby connecting the electric pump 40 to the block body 11. Note that the electric pump 40 is fixed to the base 21 by fixing the pump fixing pieces 41 of the electric pump 40 to the base 21 of the case 20 using the tapping screws T after being connected to the block body 11.

After the electric pump 40 is fixed, the intake connecting portions 61 of the measuring device 60 are fit into the openings of the connecting pipes 14B for measuring device of the block body 11 to connect the measuring device 60 to the block body 11. Note that the measuring device 60 is fixed to the block body 11 by fixing the measuring device fixing pieces 62 of the measuring device 60 to the upper end surface of the small box portion 13 using the tapping screws T after being connected to the block body 11. Further, before the cover 22 is assembled with the base 21, the surface seal 18 is mounted on the upper end surface of the large box 12 of the block body 11 by inserting the connecting tubes 14A for measuring device and the connecting tube 15A for device through the tube insertion holes 18A of the surface seal 18 (see FIG. 10).

Figure 11:
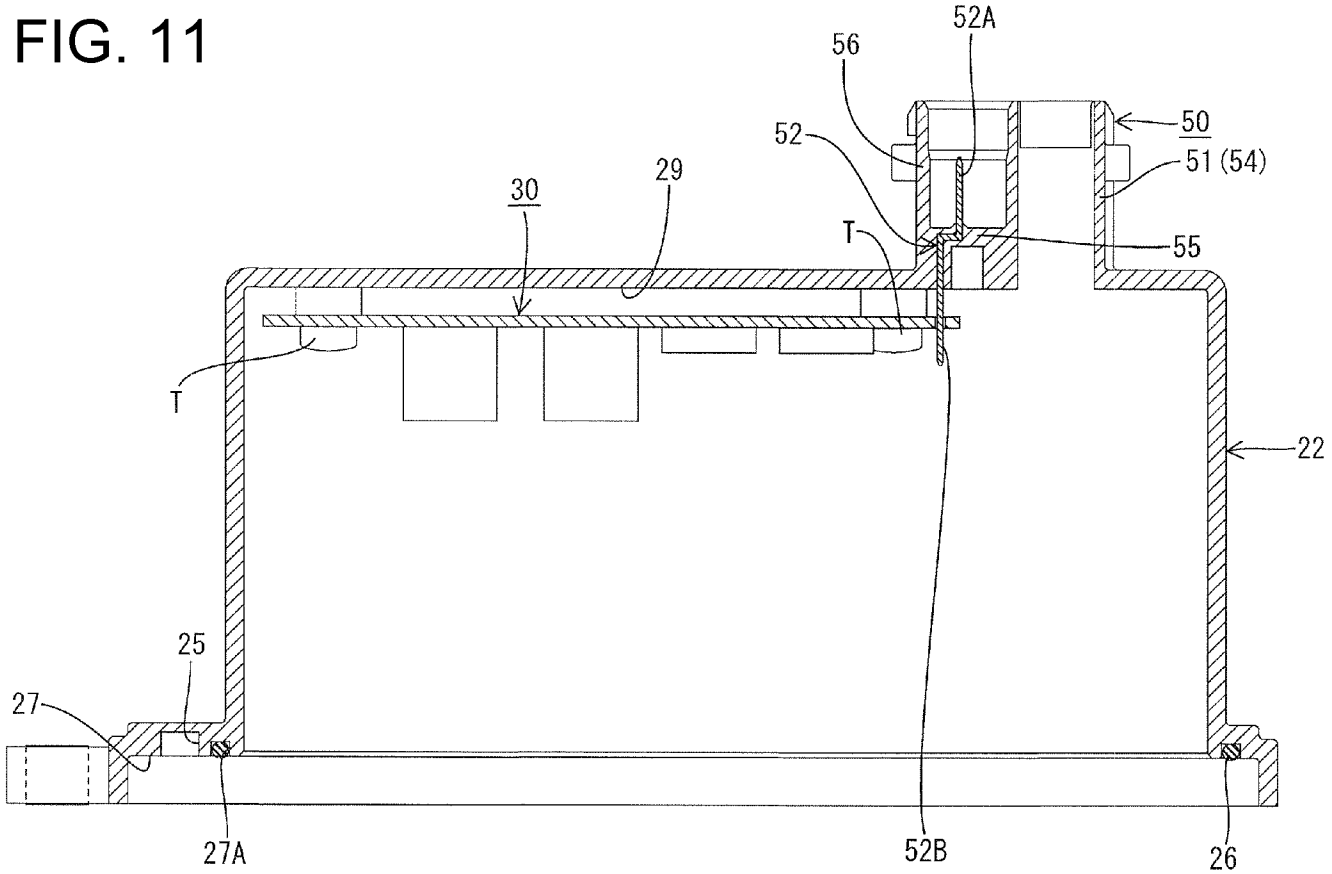
FIG. 11 is a section showing a control board is assembled with a cover.
Figure 12:
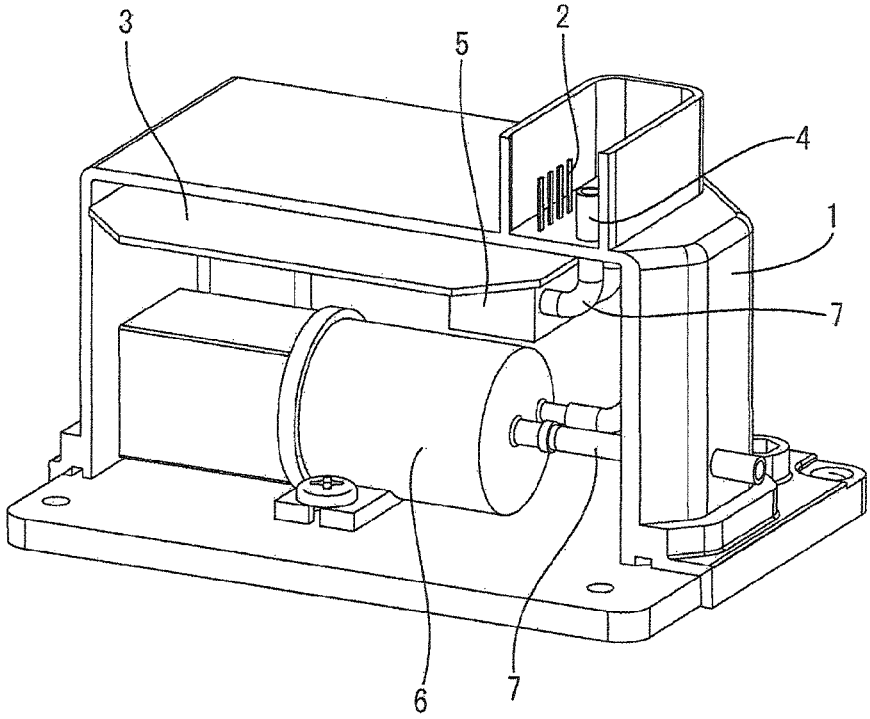
FIG. 12 PRIOR ART
FIG. 12 is a cutaway perspective view showing a conventional exhaust gas measuring apparatus.

On the other hand, as shown in FIG. 11, the through holes 31 of the control board 30 are fit to the lower-end connecting portions 52B of the joint terminals 52 in the connector 50 for electrically connecting the control board 30 to the joint terminals 52, and the control board 30 is fixed to the upper inner surface 29 of the cover 22 of the case 20 by the tapping screws T. Before the cover 22 is assembled with the base 21, the annular seal 26 is mounted in the annular groove 27A of the stepped portion 27 provided at the opening edge of the cover 22.

After all the devices and members are assembled with the base 21 and the cover 22 in this way, the cover 22 is mounted to cover the base 21 (particularly substantially from above)

and fixed to the base 21 by screwing the tapping screws T into the cover 22 from the bottom surface of the base 21. At this time, the connector 50 and the block body 11 can be connected by mounting the cover 22 so that the connecting tubes 14A for measuring device and the connecting tube 15A for device of the block body 11 are inserted into the joint pipes 51 of the connector 50 in the cover 22. Further, the surface seal 18 mounted on the upper end surface of the large box 12 of the block body 11 beforehand is pressed and squeezed between the upper inner surface 29 of the cover 22 and the upper surface of the large box 12, thereby preventing the exhaust gas from flowing into the case through the clearances between the joint pipes 51 and the connecting tubes 14A for measuring device and the connecting tube 15A for device.

As described above, in the gas distribution unit 10 the openings of the intake passage for device, the exhaust passage for device and the air passages for measuring device are formed at specified positions where the respective devices are to be mounted, so that the connecting portions of the respective devices can be inserted into the corresponding openings and the respective pipes and the respective devices can be joined by mounting the respective devices into the case 20. Thus, it is not necessary to arrange and mount gas tubes after the devices are fixed to the case, as in the prior art, and assembling efficiency of the exhaust gas measuring apparatus can be improved drastically. Also when an additional device is mounted into the case and the number of gas passages increases, there is no additional step of mounting a gas tube to the added device since gas tubes are not employed.

Further, the gas flow passages are made e.g. of synthetic resin, and will not bend or fold to close the gas flow passages. Thus, exhaust gas can be passed reliably.

Plural intake passages for measuring device are arranged substantially side by side so that plural intake connecting portions on the measuring device can be fit collectively. Thus, it is not necessary to connect the intake connecting portions one by one as in the prior art and assembling operability can be improved.

The invention is not limited to the above described and illustrated embodiment. For example, the following embodiments also are included in the scope of the invention.

In the above embodiment, the joint pipes 51 penetrate the upper wall of the cover 22 and the connecting tubes 14A for measuring device and the connecting tube 15A for device on the upper surface of the block body 11 are fit into the joint pipes 51 when the cover 22 is assembled with the base 21. However, the invention is not so limited. For example, the joint pipes 51 may be on the base 21 like the exhaust pipe 28 on the base 21, and the connecting tubes 14A for measuring device and the connecting tube 15A for device may be connected to the joint pipes 51 when the block body 11 is fixed to the base 21, so that nothing is connected when the cover 22 is assembled with the base 21.

Three intake connecting portions 61 of the measuring device 60, three pipes 53 for measuring device and three intake passages 14 for measuring device of the connector 50 are provided in the above embodiment. However, there may be a combination of one, four or more intake connecting portions 61 of the measuring device 60, pipes 53 for measuring device and intake passages 14 for measuring device of the connector 50.

The surface seal 18 is mounted at the outer peripheral portions of the base ends of the connecting tube 15A for device and the connecting tubes 14A for device on the upper end surface of the large box 12 to seal between the upper inner surface 29 of the cover 22 and the upper end surface of the large box 12 in the above embodiment. However, the invention is not so limited. For example, O-rings may be mounted on peripheral surfaces of the connecting tube 15A for device and the connecting tubes 14A for device to seal clearances between the connecting tube 15A for device and the connecting tubes 14A for device and the joint pipes 51, into which the connecting tube 15A for device and the connecting tubes 14A for device are accommodated and fit.

What is claimed is:

1. A gas distribution unit including an integral or unitary block body made of rigid synthetic resin and to be fixed in or to a case of an exhaust gas measuring apparatus, the block body comprising:

an L-shaped intake passage having a first end extending up from a top surface of the block body and disposed to be connected to an intake pipe on the case and a second end extending from a front surface of the block body and disposed to be connected to an intake connecting portion on a pump in the case;

an L-shaped exhaust passage having a first end open at a bottom surface of the block body and disposed to be connected to an exhaust pipe on the case and a second end projecting forward from a front surface of the block body and disposed to be connected to an exhaust connecting portion on the pump; and an L-shaped air passage having a first end projecting from the top surface of the block body and disposed to be connected to a pipe for a measuring device provided on the case and a second end projecting from the front surface of the block body and disposed to be connected to an intake connecting portion provided on the measuring device in the case.

2. The gas distribution unit of claim 1, wherein the case includes a base to which the block body is fixed, and a cover mounted on the base to cover a surface of the base.

3. The gas distribution unit of claim 2, wherein the intake pipe penetrates through the base and the pipe for the measuring device penetrates through the cover.

4. The gas distribution unit of claim 3, wherein a connecting tube for the pump is provided at the first end of the intake passage and a connecting tube for the measuring device is provided at the first end of the air passage for the measuring device, the connecting tube for the pump and the connecting tube for the measuring device are provided on an outer surface of the block body.

5. The gas distribution unit of claim 4, wherein the connecting tube for the pump is connected to the intake pipe and the connecting tube for the measuring device is connected to the pipe for the measuring device when the cover is mounted on the base.

6. The gas distribution unit of claim 5, further comprising a seal for sealing between the cover and the block body at positions outward of the connecting tube for device and the connecting tube for measuring device.

7. The gas distribution unit of claim 2, wherein:

the cover includes a plurality of pipes for the measuring device;

the measuring device includes a plurality of intake connecting portions; and the block body is formed with a plurality of air passages for the measuring device substantially corresponding to the pipes for the measuring device and the intake connecting portions.

8. The gas distribution unit of claim 2, further comprising an annular seal between the base and the cover.

9. The gas distribution unit of claim 7, further comprising seals between the intake connecting portions and the connecting pipes for the measuring device to prevent exhaust gas or fluid from flowing into the case.

10. The gas distribution unit of claim 7, further comprising seals between the intake connecting portion and the intake passage for device to prevent exhaust gas or fluid from flowing into the case.

11. The gas distribution unit of claim 1, further comprising a connector on the case, the connector including:

one or more joint pipes to be connected to one or more respective mating joint pipes provided in a mating connector to introduce exhaust gas supplied from the mating connector into the case and one or more joint terminals to be connected to one or more respective mating terminals in the mating connector.

* * * * *